United States Patent [19]

Gronnerud et al.

[11] Patent Number: 4,493,368

[45] Date of Patent: Jan. 15, 1985

[54] HELICAL FLOW HEAT EXCHANGER HAVING INDIVIDUALLY ADJUSTABLE BAFFLES

[75] Inventors: Rolf Grønnerud, Oslo; Einar Bøe, Notodden, both of Norway

[73] Assignee: Norsk Hydro a.s., Oslo, Norway

[21] Appl. No.: 386,417

[22] Filed: Jun. 8, 1982

[30] Foreign Application Priority Data

Jun. 22, 1981 [NO] Norway ..... 812113

[51] Int. Cl.[3] ..... F28F 9/22

[52] U.S. Cl. ..... 165/159; 165/162

[58] Field of Search ..... 165/162, 69, 82, 134 R, 165/159, 160, 161

[56] References Cited

U.S. PATENT DOCUMENTS

| | | | |
|---|---|---|---|
| 1,578,031 | 3/1926 | Hodgkinson . | |
| 1,599,370 | 9/1926 | Muhleisen . | |
| 1,788,386 | 1/1931 | Ehrhart | 165/162 |
| 1,796,708 | 3/1931 | Grace | 165/159 |
| 1,798,354 | 3/1931 | Ris | 165/159 |
| 1,845,546 | 2/1932 | Smith . | |
| 1,855,552 | 4/1932 | Jacocks et al. | 165/82 X |
| 1,894,279 | 1/1933 | Meyer | 165/162 |
| 2,259,604 | 10/1941 | Banks . | |
| 2,268,386 | 12/1941 | Fisher | 165/159 |
| 2,496,301 | 2/1950 | Meixl | 165/162 |
| 2,552,416 | 5/1951 | Farkas . | |
| 2,581,121 | 1/1952 | McCurdy, Sr. et al. | 165/162 |
| 2,693,942 | 11/1954 | Guala | 165/161 |
| 3,212,570 | 10/1965 | Holman | 165/162 |
| 4,190,104 | 2/1980 | Frei | 165/162 |

FOREIGN PATENT DOCUMENTS

| | | | |
|---|---|---|---|
| 54-54359 | 4/1979 | Japan | 165/162 |
| 176753 | 11/1922 | United Kingdom . | |
| 343600 | 3/1931 | United Kingdom . | |
| 1601667 | 11/1981 | United Kingdom | 165/162 |

*Primary Examiner*—Sheldon J. Richter

*Attorney, Agent, or Firm*—Wenderoth, Lind & Ponack

[57] ABSTRACT

A shell and tube heat exchanger includes a central pipe situated in the shell and provided with a number of individually adjustable baffles. An entire bundle of tubes is built around the central pipe. The baffles are movable with respect to the central pipe by means of a pull-push rod positioned in the central pipe.

8 Claims, 3 Drawing Figures

HELICAL FLOW HEAT EXCHANGER HAVING INDIVIDUALLY ADJUSTABLE BAFFLES

BACKGROUND OF THE INVENTION

The invention relates to a heat exchanger of the so-called shell and tube type with integrated baffles which by means of their design and location in the shell give a heat transfer favourable flow pattern for the medium in the shell and at the same time provide the necessary support for the tube bundle placed in the shell.

Different guide means for providing cross flow in the shell, transversely with respect to the tubes in order to improve the heat transfer, are known. However, such enforced change in flow direction results in non-uniform velocity distributions with a high pressure drop so that an improvement in the heat transfer corresponding to pressure drop is not achieved.

Furthermore, relative high flow velocities used in the heat exchangers often involve tube vibration resulting in mechanical break-down of the tube bundle.

In addition, there are zones of low flow velocity with reduced heat transfer and danger of deposit formations with the known guide means.

GB Pat. No. 1,601,667 discloses an improved arrangement of flow guiding means forming a spiral staircase type guide for the flowing medium. Even this improved arrangement does not ensure a uniform helical flow in the shell with minimal pressure drop. Edges of sector-shaped flow guide elements abut the inner surface of the shell, and no means to strain the inserted tubes are provided, so that the arrangement is vulnerable to mechanical break-down in case of tube vibration.

SUMMARY OF THE INVENTION

It is therefore an object of the present invention to provide a heat exchanger which ensures a high heat transfer with a minimal pressure drop, a fail-proof mechanical construction which is applicable to a variety of operational conditions (pressure, temperature, velocities, medium) and is based on the use of series-produced, pre-fabricated components.

Another object of the invention is to provide a heat exchanger with low weight and low manufacturing, installation, operation and maintenance costs.

The above objects according to the invention are achieved by a heat exchanger construction as distinctly claimed in the accompanying claims.

BRIEF DESCRIPTION OF THE DRAWINGS

The invention will be in the following text described in more detail in connection with an embodiment of heat exchanger which is especially suitable for the object according to the invention and shown in the accompanying drawings, where.

DETAILED DESCRIPTION OF THE INVENTION

Figure 1:
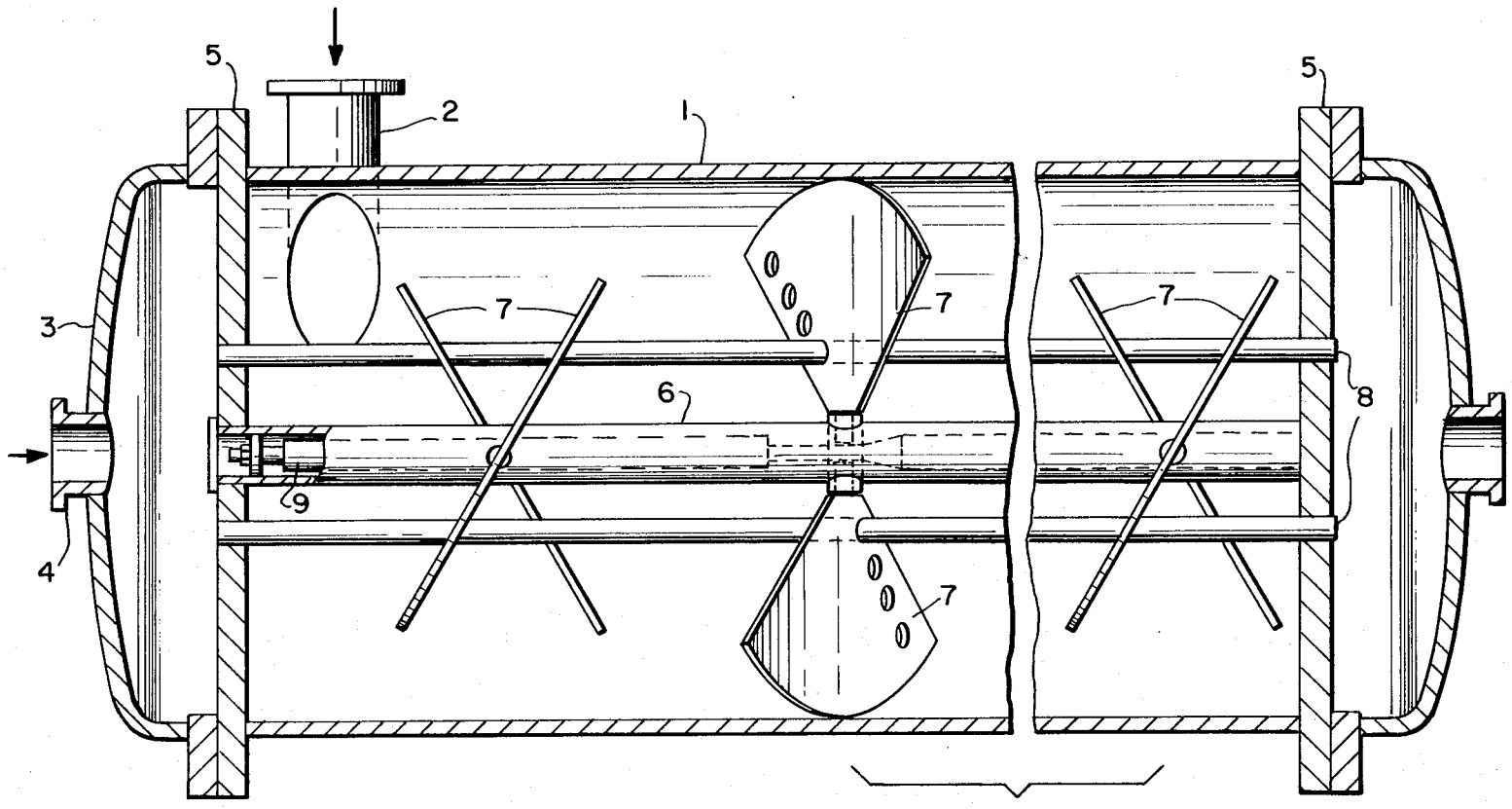
FIG. 1 is a schematic longitudinal section through a heat exchanger with a central pipe and baffles.

In FIG. 1 is schematically shown a heat exchanger comprising a shell (1) with an inlet (2) for tangential inflow of a heating/cooling medium. A corresponding medium outlet is situated in the other end of the shell (not shown in the Figure).

A shell bottom (3) with a connecting piece (4) for the tube bundle are known components in a conventional shell and tube heat exchanger. A central pipe (6) lathed in both ends and concentrically fastened to tube sheets (5) makes a reference line for construction of the tube bundle.

Movable baffles (7), which support heat-exchanger tubes (8) are provided with a plurality of apertures through which extend the tubes, and are exactly adjusted in relation to the reference line both with respect to inclination and distance from the central line. A pull-push rod (9) situated in the central pipe engages the movable baffles (7) to strain the heat exchanger tubes (8).

Figure 2:
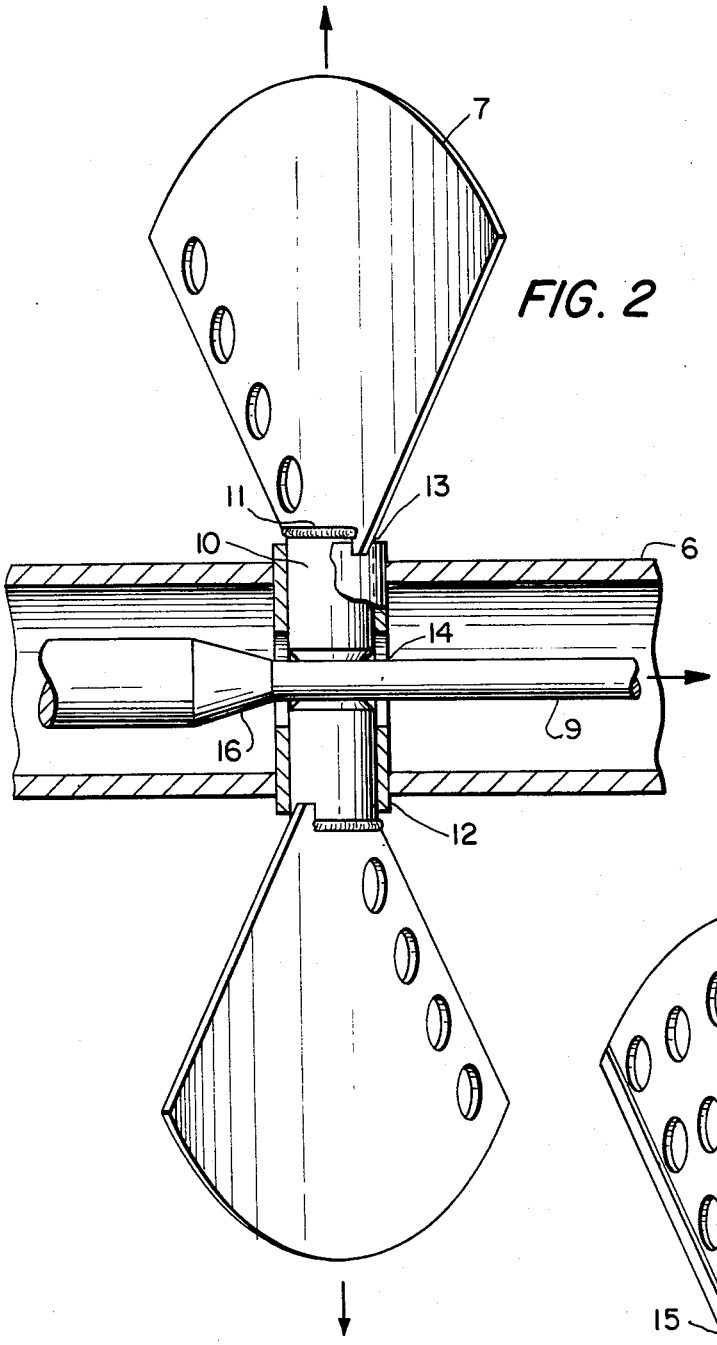
FIG. 2 is an enlarged detail of fastening and moving mechanism for baffles.

The principle for fastening the baffles to the central pipe and the movement mechanism for the baffles is shown in FIG. 2. Each baffle (7) is provided with a bolt (10), fastened e.g. by means of welding (11) as indicated in the Figure. The central pipe (6) is provided with a number of guiding sockets (12) for insertion of the bolts (10) with the baffles which are movable with regard to the central pipe.

The baffles are grouped in pairs, e.g. as shown in the Figure, either as the above described movable baffles or alternately with fixed baffles fastened by means of bolts (10) (not shown in the Figure) directly to the central pipe. The guiding sockets (12) fixed to the central pipe are provided with guiding slots which are engaged with the lower edges (13) of the baffles in such a way that the respective position and angle of the baffles in relation to the central line of the central pipe and to each other are fixed.

The guiding sockets (12) are manufactured with a through opening (14) in such a way that the pull-push rod (9) can be inserted through all sockets in the central pipe. The pull-push rod itself, which activates the baffles (7) through guiding bolts (10) so that the baffles are moved out from the central line and towards the shell and in this manner strain the heat-exchanger's tubes (8), is formed as a cylindrical body with two different diameters. The transition part (16) in the pull-direction between these two diameters has a conical shape and this shape ensures a displacement of heat exchanger's tubes during movement of the pull-push rod.

Thereby the heat exchanger's tubes are strained and tube vibrations are prevented. The pull-push rod can also be designed so that the baffles are moved in other directions than at right angles to the central pipe.

Figure 3:
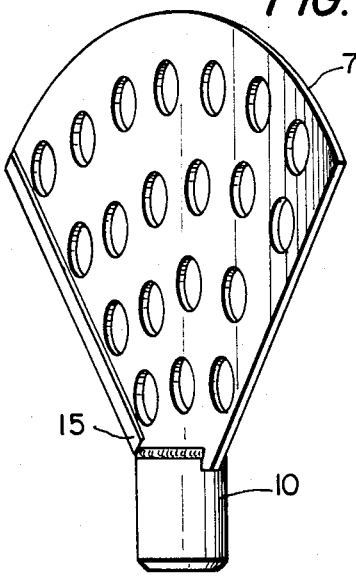
FIG. 3 is a perspective view of a baffle with a bent edge for collection and draining of condensate.

FIG. 3 shows a baffle (7) attached to a fastening bolt (10) and formed with a bent edge (15). In a vertical installed heat-exchanger such bent plate edges will function as collecting gutters for draining of condensate, which under certain applications of heat exchangers is formed on the tube surfaces and diminishes the heat transfer by free flow along the tubes. The adjustable baffles are fixed to the central pipe at angles which make it possible for the condensate to be carried along the baffle towards the bent edge, and further to the shell's inner-side so that the formation of thick, continuous condensate films on the tubes is reduced.

A heat exchanger according to the invention as described above and illustrated by the accompanying FIGS. 1–3, functions in the following manner:

The baffles grouped in pairs and individually adjustable offer a high flexibility with regard to the creation and control of the flow dynamics in the shell. Based on the series-produced, pre-fabricated components it is possible, by choosing distance between the baffles and their inclination, to vary the flow velocity pattern within a large range and to choose the flow pattern which is optimal for a given application, medium or the heat exchanger's size/capacity. A central pipe composed of several sections with individual configuration and adjustment of the baffles allows for variations in the flow patterns, e.g. from high velocities in the inlet part to lower velocities at the outlet, where such arrangement is appropriate with regard to performance under difficult conditions as in heavy duty (dirty) services, inert gases, etc. The existence of so called "dead zones", typical for the conventional shell and tube heat exchangers, with reduced heat transfer and formation of deposits on some parts, e.g. behind the baffles, is practically eliminated.

The method of straining the heat exchanger tubes which are inserted through the baffles makes it possible to use bigger clearance between the baffle's apertures and tubes. The requirement for accuracy of tolerances is lower, the work to insert the tubes in the baffles is facilitated and at the same time cheaper tubes can be used and the danger of tube vibrations is still eliminated.

The construction of the entire tube bundle around a fixed central pipe used as a reference line facilitates mechanization/automation of the component manufacture and the operation, and at the same time an adequate degree of precision during the entire construction of the heat exchanger is automatically secured.

The heat exchanger as shown in FIGS. 1–3 and described above represents only one practical embodiment according to the invention. Other constructions and modifications of the disclosed heat exchanger can be applied within the scope of the present invention. An example in order to achieve even more favourable pressure drop characteristics in the heat exchanger's longitudinal direction in terms of flow dynamics on the shell side, instead of the usual, symmetrical tubes with circular cross section as heating/cooling elements in the tube bundle, there can be used tubes having an oblong cross section as e.g. elliptical tubes, flat oval tubes or tubes having drop-like shaped hollow profiles, where the orientation of the longitudinal axis of their cross section is substantially identical with the main direction of the fluid flow in the shell. The special combination of tangential inlet of the medium with spiral forming partition walls formed by the adjustable baffles in the shell and tubes of oblong cross section arranged in concentric circles results in further reduced pressure drop in the heat exchanger. The distances between concentric circles of tubes in the bundle can be made equivalent as shown in Figures, or vary along the shell's cross section.

The baffles can be also provided with one or more grooves instead of the bent edge as shown in FIG. 3. The number and location of the grooves will vary according to consistency, composition and amount of the condensate.

We claim:

1. A helical flow heat exchanger comprising:
   - a shell having an inlet and an outlet for circulating a medium through said shell;
   - tube sheets fixed to said shell adjacent opposite ends thereof;
   - a central pipe fixed to said tube sheets and extending through said shell;
   - a plurality of elongated tubes extending between said tube sheets through said shell;
   - a plurality of baffles supporting said tubes within said shell, said baffles being individually adjustable in a predetermined position and inclination with respect to said central pipe, to ensure a helical flow pattern of the medium through said shell and around said tubes; and
   - fastening means for connecting said baffles to said central pipe.

2. A heat exchanger as claimed in claim 1, wherein said central pipe extends coaxially through said shell, said fastening means includes a plurality of guiding sockets receiving said baffles, and comprising a push-pull mechanism extending through said central pipe for moving said baffles within said sockets with respect to said central pipe.

3. A heat exchanger as claimed in claim 2, wherein said baffles are movable substantially at right angles to said central pipe.

4. A heat exchanger as claimed in claim 2, wherein said push-pull mechanism comprises a push-pull rod.

5. A heat exchanger as claimed in claim 4, wherein said push-pull rod comprises a cylindrical body having two different diameter portions joined by a conical transition portion.

6. A heat exchanger as claimed in claim 1, wherein said central pipe is positioned eccentrically with respect to the longitudinal axis of said shell.

7. A heat exchanger as claimed in claim 1, wherein said tubes are elliptical in cross-section.

8. A heat exchanger as claimed in claim 1, wherein said tubes are oval in cross-section.

* * * * *